US005992327A

United States Patent [19]

Wardecki et al.

[11] Patent Number: 5,992,327

[45] Date of Patent: Nov. 30, 1999

[54] SUB-AMMUNITION OBJECT FOR VAPOR GENERATION

[75] Inventors: Norbert Wardecki, Heuweiler; Herwig Feldmeier, March, both of Germany

[73] Assignee: Buck Werke GmbH & Co., Uberkingen, Germany

[21] Appl. No.: 09/074,381

[22] Filed: May 8, 1998

[30] Foreign Application Priority Data

Mar. 12, 1997 [DE] Germany ..... 197 53 661
May 9, 1997 [DE] Germany ..... 197 19 701

[51] Int. Cl.[6] ..... F42B 12/48

[52] U.S. Cl. ..... 102/334; 102/489; 102/289

[58] Field of Search ..... 102/289, 334, 102/489

[56] References Cited

U.S. PATENT DOCUMENTS

| | | | |
|---|---|---|---|
| 3,301,187 | 1/1967 | Donaldson et al. | 102/293 |
| 3,734,020 | 5/1973 | Ciccone et al. | 102/443 |
| 4,066,415 | 1/1978 | Kasama et al. | 102/531 X |
| 4,234,787 | 11/1980 | Wacula et al. | 102/501 |
| 4,353,301 | 10/1982 | Jacobsen | 102/334 |
| 4,622,899 | 11/1986 | Weber | 102/334 |
| 4,682,544 | 7/1987 | Koroscil et al. | 102/336 |
| 4,697,521 | 10/1987 | Espagnacq et al. | 102/334 |
| 4,791,870 | 12/1988 | Simpson | 102/342 |
| 4,922,826 | 5/1990 | Busch et al. | 102/489 |
| 4,956,029 | 9/1990 | Hagel et al. | 149/19.8 |
| 5,033,384 | 7/1991 | Eckel et al. | 102/489 X |
| 5,033,385 | 7/1991 | Zeren | 102/489 |
| 5,656,794 | 8/1997 | Krone et al. | 102/334 X |
| 5,684,266 | 11/1997 | Remerowski | 102/531 X |

FOREIGN PATENT DOCUMENTS 28 30 119 1/1980 Germany .

*Primary Examiner*—Peter A. Nelson
*Attorney, Agent, or Firm*—Burns, Doane, Swecker & Mathis, L.L.P.

[57] ABSTRACT

The invention relates to a sub-ammunition object for vapor generation for a spinstabilized carrier projectile with axial sub-ammunition discharge, consisting of a stackable, flat, disk-shaped, stamped part of identical caliber, which, at a height/width ratio of about 1:1.5 to 1:5, contains red phosphorus as the primary active substance and is designed to retain its structural and form stability during firing, discharge, and stacking as a result of fibers embedded in the active substance and/or a shell, with the combustion time being chemically and/or physically adjustable through the height, compression pressure and/or composition of the active substance. It is preferred that the active substance be located in a container with at least one blower aperture and one oxygen donor as the energy supply needed for combustion of the red phosphorus in the container.

17 Claims, 1 Drawing Sheet

SUB-AMMUNITION OBJECT FOR VAPOR GENERATION

BACKGROUND OF THE INVENTION

The current invention relates to a sub-ammunition object for vapor generation.

The manufacture of rotationally symmetrical sub-ammunition objects for vapor projectiles with a height/diameter ratio of about 1:1, where four to five sub-ammunition objects or fewer are integrated into a projectile shell, is known. As the sub-ammunition is centrally positioned in the projectile and the angular momentum of the projectile shell is transferred to the sub-ammunition, the sub-ammunition objects remain stable on a secondary flight path after being discharged, thereby avoiding excessive dispersion of the sub-ammunition objects on the ground.

The number of vapor sources on the ground can be increased by increasing the number of sub-ammunition objects per projectile. The development of a homogeneous vapor cloud is desirable in this regard. This is particularly important when the vapor effect in the immediate vicinity of the individual vapor object contributes substantially to overall coverage as is, for example, the case with vapors that are actively emitted in infrared zones.

Until now, the multiplication of sub-ammunition objects was achieved by designing the sub-ammunition objects in the form of cylinder segments or wedges (so-called "wedges"), which were radially arranged around the center axis of the projectile. Each of these objects had a weight of up to one bomblet. When the projectile is discharged, however, the secondary flight path of these segments or wedges is adversely affected by the angular momentum of the projectile in a manner similar to that of inserted bomblet projectiles. This results in high radial acceleration after discharge which, in turn, leads to the distribution of the vapor objects over a large area and, furthermore, is heavily dependent on the discharge height. Consequently, there is a risk that the vapor objects will be too widely dispersed, thereby creating a non-homogeneous vapor cloud.

For example, projection objects with vapor charges are known from U.S. Pat. No. 4,353,301 (DE 29 08 116) and DE 28 30 119 Al in which at least a portion of the active substance is designed in the form of a plate with a central blasting/ignition charge or a central powder core.

Another known method involves adjusting the combustion time of a sub-ammunition through its height, compression pressure and/or the composition of its active vapor-forming ingredient. Thus, for example, the adjustment of the combustion speed of a vapor charge through the use of special recipes is known from U.S. Pat. No. 4,697,521 (DE 33 26 884).

In another example, U.S. Pat. No 4,791,870 (DE 37 07 694) discloses an ignition charge containing a nitrocellulose propellant charge pellet and fibers made of a conductive material. A pyrotechnic mixture of red phosphorus and a binding agent is, for example, known from U.S. Pat. No. 4,791,870 (DE 34 43 778). In addition, many experiments have already been performed on the combustion of active vapor-forming materials based on red phosphorus. In these experiments, the ability to control combustion in terms of the homogeneity of the vapor being produced and in terms of localization of same represents a central problem. And a fire hazard and environmental damage cannot be fully ruled during conventional combustion.

SUMMARY OF THE INVENTION

The objective of the invention is to provide sub-ammunition objects for vapor generation which, when used in projectiles or mortar shells, bundle the basic pattern (the so-called "ground pattern"), i.e., resulting, in particular, in a more homogeneous vapor cloud than has been possible previously. In addition, a potential fire hazard is to be avoided and the environment protected.

According to the invention, this objective is achieved with a sub-ammunition object for vapor generation for a spin-stabilized carrier projectile with axial sub-ammunition discharge, consisting of a stackable, flat, disk-shaped, stamped part of identical caliber, which, at a height/width ratio of about 1:1.5 to 1:5, contains red phosphorus as its primary active substance and is designed to retain its structural and form stability during firing, discharge, and stacking as a result of fibers embedded in the active substance and/or a shell, with the combustion time being chemically and/or physically adjustable through the height, compression pressure and/or composition of the active substance.

One embodiment can be characterized by an ignitor and/or ignition delay mechanism, preferably containing an ignition breakdown charge which runs through the center of the pressed part, ignites the active substance, and separates the pressed parts.

Another proposal according to the invention consists in providing the shell in the form of a foil or container, with the container preferably comprising a supporting frame for acceptance of the projectile load during discharge.

Another preferred embodiment of the invention is characterized in that the active substance is located in a container with at least one blower aperture and an oxygen donor as the energy supply needed for combustion of the red phosphorus in the container.

It may be provided that the oxygen donor is selected from a group consisting of at least one oxide, such as iron oxide or peroxide sulfate, persulfate, one perchlorate and/or one nitrate.

Furthermore, black blasting powder, preferably sulfur-free black blasting powder or nitrocellulose powder, possibly mixed with vapor action material, can be used to increase the capacity for ignition of the active substance in accordance with the invention.

It may be provided that the black blasting powder or nitrocellulose powder, possibly mixed with active substance is positioned around an ignition channel.

According to the invention, at least one opening, especially in the form of a blower aperture, may be provided to control pressure inside the container (2*a*, 2*b*, 2*e*) and, consequently, to control combustion of the active substance.

Another proposal according to the invention is that the blower aperture can be enlarged during combustion of the active substance, preferably by the melting of at least one aluminum insert in the container.

Another proposal according to the invention is that the amount of oxygen donor in the active substance varies spatially to equalize mass conversion during combustion of the active substance, with the active substance exhibiting—from the inside, particularly from the ignition channel along the latitudinal axis, to the outside—a combustion surface which increases during combustion, as well as a quantity of oxygen donor that conforms to this surface.

Another proposal according to the invention is that the active substance inside the container is divided into two or more components, with one component in the ignition area of the active substance comprising approximately 40% to approximately 60% red phosphorus, approximately 20% to approximately 40% oxygen donor, approximately 0% to approximately 20% metal powder, and approximately 0% to approximately 10% binder, and another component (3*c*) in the area opposite the ignition area comprising approximately 70% to approximately 90% red phosphorus, approximately 10% to approximately 20% oxygen donor, approximately 0% to approximately 20% metal powder, and approximately 0% to approximately 10% binder. All percentages refer to percentages in weight.

As a result of there being a plurality of components in the active substance, a gradation of the oxygen donor content, which depends on the phosphorus content and/or container geometry, with steps ranging from approximately 3% to approximately 0% being preferred, may be provided.

Thus, the invention is based on the surprising realization that by calibrating or dividing the height of the active substance by three, four, or five in relation to its width, i.e., by reducing the mass and, consequently, the weight, and by simultaneously decelerating the time of action by adjusting physical and chemical parameters, the number of sub-ammunition objects per projectile or mortar shell can be increased without resulting in the unwanted broad distribution of the sub-ammunition objects along their secondary flight paths, thereby largely avoiding non-homogeneous vapor clouds. This is why the preferably disk-shaped and reinforced sub-ammunition objects are spin-stabilized and are not flung radially and are, consequently, vastly superior to conventional "wedges" or even known disk-shaped charges.

According to an embodiment of the invention, an ignition breakdown charge reacts spontaneously after ignition, thereby forming a large volume of hot gases. The hot gases, in turn, ignite the active substance, possibly through an ignition delay device, while the pressure buildup blows off the section—not depicted in the figure—which supports the sub-ammunition object, and the sub-ammunition is pulled out by the escaping gases.

Preferably, the shell according to the invention can fulfill two functions. On the one hand, the active substance "disks" can be individually ignited, in the air or on the ground, by means of an ignitor or ignition delay device attached to the corresponding shell while, on the other hand, the risk of collapse due to angular momentum or similar forces is minimized. The latter function can be improved by reinforcing the active substance, e.g., by the embedding of fibers. Furthermore, the shells according to the invention can also contain a supporting frame that absorbs the projectile loads during discharge, Another embodiment of the invention is also based on the surprising realization that vapor generation by means of an active substance can be localized and thereby homogenized, in that the combustion of the red phosphorus occurs inside a container and vapor only escapes through one or more precisely delineated blower apertures, while combustion of the red phosphorus in the container is controlled by the oxygen donor content and the pressure inside the container. On the one hand, the combustion of the red phosphorus in the container increases environmental compatibility while, on the other, substantially reducing the risk of the ammunition being burned during use.

According to the invention, the effectiveness of red phosphorus combustion can be increased by controlling the oxygen donor content and the internal pressure in the container, resulting in an experimentally confirmed reaction of up to 75%, while a conventional open-air reaction falls within a range of about 30%. According to the invention, the internal pressure in the container can be controlled in such a way as to ensure a complete reaction of the red phosphorus. Furthermore, and according to the invention, a self-enlarging blower aperture can be used to regulate pressure, e.g., through the use of an aluminum insert that melts away during hot combustion of the red phosphorus. In addition, because combustion is largely contained and the reaction is highly efficient, enrichment of nitrates in the ground does not occur, as un-ignited vapor action material is largely prevented from penetrating the ground.

As the combustion of a disk-shaped sub-ammunition object preferably occurs in radial fashion from the inside toward the outside, the combustion surface will become enlarged during the combustion period and, consequently, more vapor will develop. To increase the homogeneity of vapor generation, this increase in vapor generation is, according to the invention, equalized by a counteracting recipe of the vapor action material. To this end, the proposal according to the invention is to reduce the energy supplier of the active substance particularly the oxygen donor, from the inside toward the outside, preferably in increments, so that mass conversion, i.e., the amount of active substance being burned over time, remains constant in spite of the increase in the combustion surface. This constant mass conversion also prevents disintegration of the sub-ammunition objects which, in turn, can result in non-homogeneity of the vapor cloud and conceal potential hazards.

According to the invention, the capacity for ignition of the vapor action material can be increased on the ignition surface, preferably at the inner bore hole, which provides two blower apertures, by adding black blasting powder or nitrocellulose powder, possibly mixed with vapor action material.

BRIEF DESCRIPTION OF THE DRAWINGS

Additional features and advantages of the invention result from the following description, in which two illustrative examples of the invention are explained in detail using schematic drawings.

DESCRIPTION OF PREFERRED EMBODIMENTS OF THE INVENTION

Figure 1:
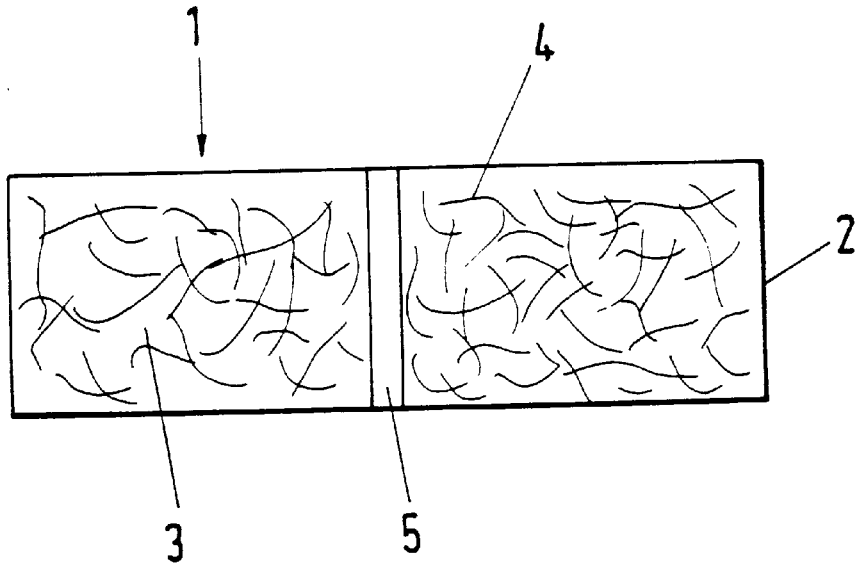
FIG. 1 depicts: a sectional view through a sub-ammunition object according to the invention.

The sub-ammunition object depicted in FIG. 1 consists of a shell 2, a vapor action material 3—as the active substance—with embedded fibers 4, as well as an ignition breakdown charge 5, and is rotationally symmetrical with a height to width ratio of 1:3, i.e., it is shaped as a disk. The vapor action material 3 contains red phosphorus. Furthermore, the shell 2 is connected to an ignition delay device (not depicted) which, if desired, is triggered by the central ignition breakdown charge 5. Upon ignition, the ignition breakdown charge 5 reacts spontaneously, forming a large volume of hot gases. These hot gases in turn ignite the vapor action material 3 via the ignition delay device, while the pressure buildup blows off the floor of a section—not depicted in the figure which supports the sub-ammunition object 1, and the sub-ammunition object 1 is pulled out by the escaping gases.

A large number of these disk-shaped sub-ammunition objects 1, each containing a reinforced and secured vapor action material 3 and an ignition delay device, can be worked into a projectile or a mortar shell, which then exhibit(s) the following advantages:

i) The basic shell is bundled.

ii) Stable secondary ballistics are achieved.

iii) The number of vapor sources per shell is increased.

iv) The option of individual ignition, both in the air and on the ground, is provided.

Figure 2:
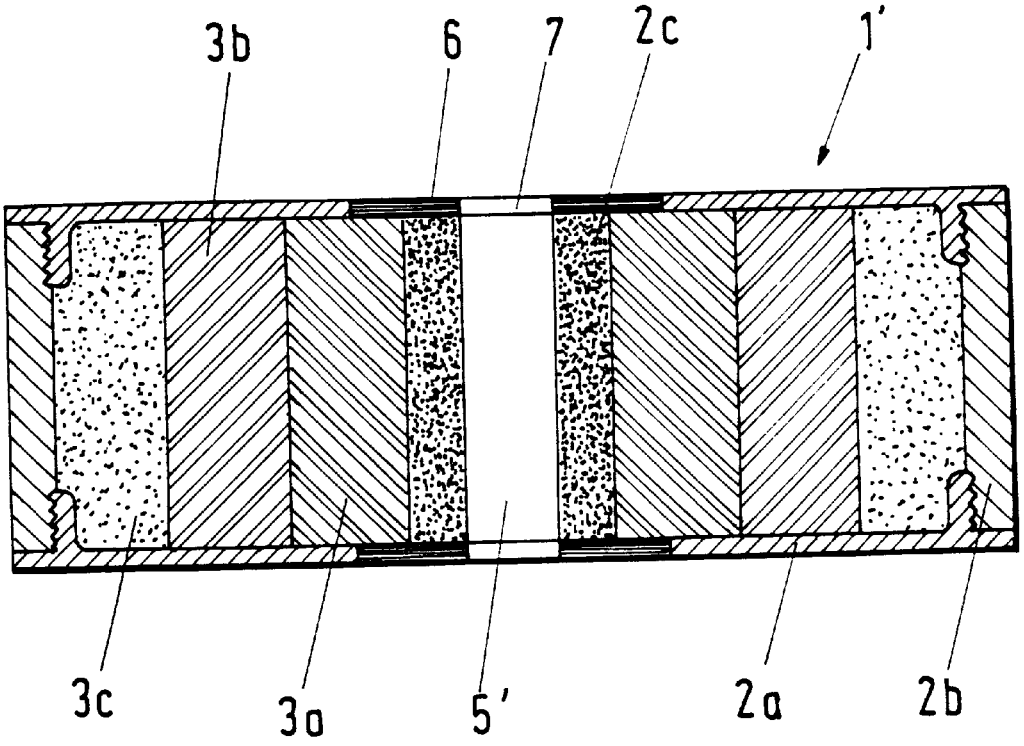
FIG. 2 depicts: a sectional view through another sub-ammunition object according to the invention.

According to FIG. 2, another sub-ammunition object 1' according to the invention includes a container comprising steel walls 2*a*, 2*b*, and aluminum walls 2*c*. A vapor action material 3*a*, 3*b*, 3*c* is located inside the container 2*a*, 2*b*, 2*c*, specifically around a central inner bore hole which represent an ignition channel 5'. Sulfur-free black blasting powder 6 is arranged around the ignition channel 5', with the inner bore hole also including two blower apertures 7. The wall 2*b* encompasses an outer peripheral side of the part formed by the vapor action materials, and the walls 2*a*, 2*c* encompass top and bottom sides of that part (except for the blower apertures). The outer peripheral side defines a height of the part, and each of the top and bottom sides define a width (diameter) of the part.

The vapor action material 3*a*, 3*b*, 3*c* exhibits a composition that changes incrementally from the inside, i.e., beginning at the sulfur-free black blasting powder 6, radially toward the outside, i.e., in the direction of the steel walls 2*b*. In this manner, the vapor action material 3*a*, 3*b*, 3*c* comprises three spatially separated components with the following compositions in percent:

i) The first vapor action material 3*a* contains
40% to 60% red phosphorus,
20% to 40% oxygen donor,
0% to 20% metal powder, and
0% to 10% binder.

ii) The second vapor action material 3*b* contains
55% to 75% red phosphorus,
15% to 30% oxygen donor,
0% to 20% metal powder, and
0% to 10% binder.

iii) The third vapor action material 3*c* contains
70% to 90% red phosphorus,
10% to 0% oxygen donor,
0% to 20% metal powder, and
0% to 10% binder.

The sub-ammunition object 1' described by reference to FIG. 2 burns as follows:

The first vapor action material component 3*a* is ignited by the sulfur-free black blasting powder 6, which results in the combustion of the first vapor action material component 3*a*. The resulting vapor can escape to the outside through the blower apertures 7 to form a vapor cloud, while combustion occurs inside the container 2*a*, 2*b*, 2*c*. The blower apertures 7 also serve to control the pressure inside the container 2*a*, 2*b*, 2*c*.

During combustion of the first vapor action material component 3*a*, the aluminum inserts 2*c* melt in succession, thereby enlarging the blower apertures 7, which further regulates pressure inside the container 2*a*, 2*b*, 2*c* to produce homogeneous combustion.

Following combustion of the first vapor action material component 3*a*, the enlarged combustion surface and the reduced oxygen donor volume results in the combustion of the second vapor action material component 3*b*, with the same mass conversion process taking place as was the case with the first vapor action material component 3*a*.

Following combustion of the second vapor action material component 3*b*, the additional increase in the size of the combustion surface and additional reduction in the oxygen donor volume leads to the combustion of the third vapor action material component 3*c*, thereby ensuring constant mass conversion during combustion.

The increase in the size of the blower apertures 7 results in additional pressure regulation during complete combustion, thereby ensuring the complete reaction of the vapor action material 3*a*, 3*b*, 3*c*.

It has become evident that the effectiveness of the ammunition 1, i.e., the ratio of vapor action material 3*a*, 3*b*, 3*c* used to residual ash. is about 75%, which represents a substantial increase over conventional ammunition, which exhibits effectiveness in the range of about 30%. This, and the fact that, as a result of the combustion of the vapor action material 3*a*, 3*b*, 3*c* in the container 2*a*, 2*b*, 2*c*, no unburned vapor action material 3*a*, 3*b*, 3*c* reaches the ground, ensures that the ammunition remains environmentally friendly.

The sub-ammunition object 1 also does not present a potential hazard in terms of its combustion outdoors and/or in terms of its disintegration as a result of uneven combustion, due to homogeneous combustion largely within the confines of a container, which, of course, represents the condition for homogeneous vapor cloud formation.

The features of the invention disclosed in the above description, in the drawings, and in the claims may be—either individually or in any combination—fundamental to the realization of the invention in its various embodiments.

What is claimed is:

1. A vapor-generating sub-ammunition object adapted for use in a spin-stabilized projectile having axial sub-ammunition discharge; the sub-ammunition object comprising a stackable, stamped, disk-shaped part including a vapor action material for generating vapor when ignited, and a charge for igniting the vapor action material; the vapor action material including red phosphorous; the part having a top side, a bottom side, and an outer peripheral side interconnecting the top and bottom sides; the outer peripheral side defining a height of the part, and each of the top and bottom sides defining a width of the part; a height-to-width ratio being in the range of about 1:2 to 1:5; the object further including a reinforcing shell substantially encompassing the top side, the bottom side, and the outer peripheral side.

2. The object according to claim 1 further including reinforcing fibers embedded in the vapor active material.

3. The object according to claim 1 wherein the shell comprises foil.

4. The object according to claim 1 wherein the shell comprises a container having at least one blower aperture formed therein, the vapor action material including an oxygen donor for promoting combustion of the red phosphorous.

5. The object according to claim 4 wherein the oxygen donor is selected from a group comprising at least one oxide.

6. The object according to claim 4 wherein a portion of the blower aperture is covered by a meltable material which melts in response to combustion of the vapor action material, to enlarge the size of the blower aperture.

7. The object according to claim 6 wherein the meltable material comprises aluminum.

8. The object according to claim 6 wherein the amount of oxygen-donor material is reduced in a radially outward direction of the object.

9. The object according to claim 4 wherein the amount of oxygen-donor material is reduced in a radially outward direction of the object.

10. The object according to claim 9, further including a centrally arranged ignition channel, the vapor-action material divided into at least first and second components disposed at different respective radial distances from the ignition channel, with the first component disposed closer to the ignition channel and comprising approximately 40% to approximately 60% red phosphorus, approximately 20% to approximately 40% oxygen donor, no more than approximately 20% metal powder, and no more than approximately 10% binder; the second component comprising approximately 70% to approximately 90% red phosphorus, approximately 10% to approximately 20% oxygen donor, no more than approximately 20% metal powder, and no more than approximately 10% binder.

11. The object according to claim 10 wherein each of the first and second components contains an oxygen donor, there being more oxygen donor in the first component than in the second component.

12. The object according to claim 11 wherein a portion of the blower aperture is covered by a meltable material which melts in response to combustion of the vapor action material, to enlarge the size of the blower aperture.

13. The object according to claim 1, further including an ignition-promoting material for increasing a capacity for ignition of the vapor action material.

14. The object according to claim 13 further including a centrally arranged ignition channel, the ignition-promoting material arranged around the ignition channel.

15. The object according to claim 14 wherein the ignition-promoting material comprises black blasting powder.

16. The object according to claim 14 wherein the ignition-promoting material comprises nitrocellulose powder.

17. A vapor-generating sub-ammunition object adapted for use in a spin-stabilized projectile having axial sub-ammunition discharge; the sub-ammunition object comprising a stackable, stamped, disk-shaped part including a vapor action material for generating vapor when ignited, and a charge for igniting the vapor action material; the vapor action material including red phosphorous; the part having a top side, a bottom side, and an outer peripheral side interconnecting the top and bottom sides; the outer peripheral side defining a height of the part, and each of the top and bottom sides defining a width of the part; a height-to-width ratio being in the range of about 1:2 to 1:5; the vapor action material including reinforcing fibers embedded therein.

* * * * *